US006953614B2

(12) United States Patent
Notsu et al.

(10) Patent No.: US 6,953,614 B2
(45) Date of Patent: Oct. 11, 2005

(54) TRANSFER SHEETS

(75) Inventors: Kazuo Notsu, Amagasaki (JP); Kenji Nakama, Himeji (JP); Hideki Nakanishi, Amagasaki (JP)

(73) Assignee: Daicel Chemical Industries, Ltd., Osaka (JP)

( * ) Notice: Subject to any disclaimer, the term of this patent is extended or adjusted under 35 U.S.C. 154(b) by 1 day.

(21) Appl. No.: 10/687,738

(22) Filed: Oct. 20, 2003

(65) Prior Publication Data

US 2004/0081774 A1 Apr. 29, 2004

Related U.S. Application Data

(62) Division of application No. 09/890,866, filed as application No. PCT/JP00/08806 on Dec. 13, 2000, now Pat. No. 6,716,493.

(30) Foreign Application Priority Data

Dec. 17, 1999 (JP) ..... 11-358605

(51) Int. Cl.[7] ..... B41M 5/40

(52) U.S. Cl. ..... 428/32.77; 427/152; 428/32.78; 428/32.79; 428/32.8; 428/32.81

(58) Field of Search ..... 428/32.81, 32.77, 428/32.78, 32.79, 32.8; 427/152

(56) References Cited

U.S. PATENT DOCUMENTS 6,406,142 B1 6/2002 Sato et al.

6,716,494 B2 * 4/2004 Nakanishi et al. ..... 428/32.12

FOREIGN PATENT DOCUMENTS

| | | | |
|---|---|---|---|
| EP | 0805049 | A1 | 11/1997 |
| EP | 0881092 | A2 | 2/1998 |
| EP | 0893269 | A1 | 1/1999 |
| JP | 09-290560 | A | 11/1997 |
| JP | 10-016382 | A | 1/1998 |
| JP | 10-053000 | A | 2/1998 |
| JP | 10-250222 | A | 9/1998 |
| JP | 11078269 | A | 3/1999 |
| JP | 11138980 | A | 5/1999 |
| JP | 2000168250 | A | 6/2000 |

* cited by examiner

*Primary Examiner*—B. Hamilton Hess
(74) *Attorney, Agent, or Firm*—Birch, Stewart, Kolasch & Birch, LLP

(57) ABSTRACT

A transfer sheet for an ink jet printer comprises a support, and a transfer layer which is capable of separating from the support and contains a hot-melt adhesive particle, and the hot-melt adhesive particle comprises a first porous hot-melt adhesive fine particle having an oil absorption of not less than 50 ml/100 g. The transfer layer may further comprise a second hot-melt adhesive fine particle having an oil absorption of less than 50 ml/100 g, a film-forming resin component, and a dye fixing agent. The hot-melt adhesive fine particle may comprise a nylon fine particle, and the average particle size thereof may be 1 to 100 mm.

3 Claims, No Drawings

TRANSFER SHEETS

This application is a Divisional of application Ser. No. 09/890,866, filed on Aug. 7, 2001, now U.S. Pat. No. 6,716,493 the entire contents of which are hereby incorporated by reference and for which priority is claimed under 35 U.S.C. §120; and this application claims priority of Application Ser. No. 11-358605 filed in Japan on Dec. 17, 1999, under 35 U.S.C. §119. This application is the national phase under 35 U.S.C. §371 of PCT International Application No. PCT/JP00/08806 which has an International filing date of Dec. 13, 2000, which designated the United States of America and was not published in English.

TECHNICAL FIELD

The present invention relates to a transfer sheet for an ink jet printer useful in forming a transfer image on an image-receiving material such as clothes by a method which comprises forming a record image with the use of an ink jet printer and transferring the record image to the image-receiving material (or member).

BACKGROUND ART

Since an ink jet recording system is easily applicable to full-color image production, and is less noisy and superior in print quality, its system has been employed for recording an image on a transfer sheet. From the viewpoints of safety and suitability for recording, a water-based ink is predominantly employed in the ink jet recording, and the recording is carried out by ejecting droplets of ink from a nozzle against a sheet. Therefore, it is essential that not only the sheet quickly absorbs the ink but also the sheet has a high fixability. Moreover, for example, when a record image is thermal-transferred to an image-receiving material such as clothes to form a transfer image by means of this transfer sheet, not only thermal transferability and adhesiveness but also high water resistance and washing resistance are required of the sheet.

For example, Japanese Patent Application Laid-Open No. 16382/1998 (JP-10-16382A) discloses a transfer medium for an ink jet recording which comprises a release layer and a transfer layer containing a fine particle of a thermoplastic resin and a polymeric adhesive of a thermoplastic resin disposed on a support, and the transfer layer may contain a crosslinking agent. Moreover, Japanese Patent Application Laid-Open No. 53000/1998 (JP-10-53000A) discloses a transfer sheet which comprises a peeling layer containing a silicone compound disposed on a support and a transfer layer containing a self-crosslinking-type polymer (e.g., a polymer having a methylol group and/or an alkoxymethyl group) disposed on the peeling layer. Further, Japanese Patent Application Laid-Open No. 290560/1997 (JP-9-290560A) discloses an image-receiving sheet for ink jet wherein a transfer layer containing a filler particle, a water-soluble thermoplastic resin and if necessary, water-insoluble thermoplastic resin is disposed on a release support. Furthermore, Japanese Patent Application Laid-Open No. 250222/1998 (JP-10-250222A) discloses a thermal-transfer medium for ink jet which comprises a support and a thermal-transfer layer containing a thermoplastic polymeric resin and a thermosetting polymeric resin (e.g., amino resin).

However, these ink-receiving layers are inadequate in ink-fixability and water resistance. In particular, because of insufficient washing resistance, a sharp transfer image can not be maintained for a long term even when a record image is thermal-transferred to clothes or the like.

Japanese Patent Application Laid-Open No. 78269/1999 (JP-11-78269A) discloses a thermal-transfer sheet in which an ink-receiving layer composed of a cationic polymer and/or an urethane-series polymer, a hydrophilic polymer and a hot-melt adhesive is formed. The thermal-transfer sheet is improved in water resistance, ink-absorption and washing resistance.

However, in the thermal-transfer sheet, ink-absorption and washing resistance are also inadequate. For example, when an ink which is difficult to dry up in a short time is employed, there is possibility that the ink is stuck on a sheet-feeding roller of an ink jet printer. In particular, in case of forming a pale- or light-color area adjacent to a deep-color area, even a little deep-color ink is stuck on a roller and further, is stuck on the pale-color area by contacting with the revolving roller, so that the pale-color area is contaminated to deteriorate an outward appearance. Such a phenomenon is called as stain transfer, and the traditional transfer sheet can not be prevented from the stain transfer. Moreover, the transferred member is washed, and an ink oozes through a surface to decline an image color concentration.

Accordingly, the object of the present invention is to provide a transfer sheet for an ink jet printer which is such excellent in ink-absorption that the stain transfer does not occur.

It is another object of the present invention is to provide a transfer sheet for an ink jet printer which is excellent in water resistance and washing resistance and can maintain a sharp image for a long term in case of thermal-transferring to an image-receiving material (e.g., clothes).

It is still further object of the present invention is to provide a transfer sheet for an ink jet printer which is superior in water resistance and washing resistance and can form a transfer image having an excellent texture.

DISCLOSURE OF INVENTION

The inventors of the present invention did intensive research, and finally found that a transfer layer, which contains at least a porous hot-melt adhesive fine particle having the specific oil absorption, is formed on a support so that an ink-absorption of a transfer sheet for an ink jet printer can be dramatically improved. The present invention was accomplished based on the above findings.

Thus, the transfer sheet for an ink jet printer of the present invention comprises a support, and a transfer layer which is capable of separating from the support and contains a hot-melt adhesive particle, wherein the hot-melt adhesive particle comprises a first porous hot-melt adhesive fine particle having an oil absorption of not less than 50 ml/100 g. The transfer layer may further comprise a second hot-melt adhesive fine particle having an oil absorption of less than 50 ml/100 g, and the ratio of the first hot-melt adhesive fine particle to the second hot-melt adhesive fine particle may be the former/the latter=about 10/90 to 50/50 (weight ratio). The first hot-melt adhesive fine particle and the second hot-melt adhesive fine particle may comprise a nylon fine particle, and the average particle size of the first hot-melt adhesive fine particle and that of the second hot-melt adhesive fine particle may be 1 to 100 mm, respectively. The transfer layer may further comprise a film-forming resin component, and a dye fixing agent and the film-forming resin component may comprise at least one member selected from the group consisting of a hydrophilic polymer, an urethane-series resin and a thermosetting or crosslinking resin. The transfer layer may comprises 10 to 10,000 parts by weight of the hot-melt adhesive particle and 1 to 200 parts by weight of a dye fixing agent relative to 100 parts by weight of the film-forming resin component. Moreover, a protecting layer capable of separating from the support may formed or disposed between the support and the transfer layer.

The present invention also includes a method for producing a transfer sheet which comprises forming, on a release side of a support, a transfer layer comprising a porous hot-melt adhesive fine particle which has an oil absorption of not less than 50 ml/100 g.

BEST MODE FOR CARRYING OUT THE INVENTION

The transfer sheet for an ink jet printer of the present invention comprises a support and a transfer layer which is capable of separating from the support and contains a hot-melt adhesive particle. Moreover, a protecting layer capable of separating from the support may be disposed between the support and the transfer layer.

[Support]

As a support, any of supports such as opaque, semitransparent and transparent supports can be used as far as the transfer layer and the protecting layer are capable of separating from the support. Examples of the support usually include a release (releasable) support, for example, a release-treated paper (a release paper), a synthetic paper, a chemical (artificial) fiber paper and a plastic film, each may be treated for providing releasability.

As a synthetic paper, there may be mentioned, a variety of synthetic papers such as one made of polypropylene, polystyrene or the like.

As a chemical fiber paper, there may be mentioned, a variety of chemical fiber papers made of chemical fibers such as nylon fiber, acrylic fiber, polyester fiber and polypropylene fiber.

As polymers constituting the plastic film, a variety of resins (a thermoplastic resin and a thermosetting resin) can be used, and a thermoplastic resin is usually employed. As the thermoplastic resin, there may be mentioned polyolefin-series resins (e.g., poly$C_{2-4}$olefin-series resins such as polypropylene), cellulose derivatives (e.g., cellulose esters such as cellulose acetate), polyester-series resins (e.g., polyalkylene terephthalate such as polyethylene terephthalate and polybutylene terephthalate, polyalkylene naphthalate such as polyethylene naphthalate and polybutylene naphthalate, or copolyesters thereof), polyamide-series resins (e.g., polyamide 6, polyamide 6/6), vinyl alcohol-series resins (e.g., polyvinyl alcohol, ethylene-vinyl alcohol copolymer), polycarbonates and the like. Among these films, a polypropylene, a polyester-series resin, a polyamide-series resin or the like is usually employed. In particular, polyester-series resins (especially, a polyethylene terephthalate) are preferred from viewpoints of mechanical strength, heat resistance and workability.

The thickness of the support can be selected according to its use, and is usually, for example, about 10 to 250 $\mu$m, and preferably about 15 to 200 $\mu$m.

The releasability can be provided or imparted by a conventional method, for example, by treating the support with a releasing agent (e.g., a wax, a salt of a higher fatty acid, an ester of a higher fatty acid, an amide of a higher fatty acid, a silicone oil) or by containing the releasing agent in the support. In case of the paper, the releasability can be imparted by coating the paper with a releasing agent (e.g., a silicone oil) after anchor treatment (e.g., clay-coat). If necessary, to the plastic film may be added a conventional additive such as a stabilizer (e.g., an antioxidant, an ultraviolet ray absorber, a thermal stabilizer), a lubricant, a nucleation agent, a filler and a pigment.

[Transfer Layer]

In the transfer sheet of the present invention, the transfer layer contains a hot-melt adhesive particle and further may contain a film-forming (film-formable) resin component, and a dye fixing agent.

(Hot-melt Adhesive Particle)

The hot-melt adhesive particle contains a first porous hot-melt adhesive fine particle having an oil absorption of not less than 50 ml/100 g as an essential component, and further may contain a second hot-melt adhesive fine particle having an oil absorption of less than 50 ml/100 g.

(1) The first hot-melt fine particle

The first hot-melt fine particle is used for the main purpose of imparting a high ink absorption to the transfer layer, and in addition, imparting the hot-melt adhesiveness to the transfer sheet.

The oil absorption of the first hot-melt fine particle is not less than 50 ml/100 g (e.g., about 70 to 500 ml/100 g), preferably not less than 75 ml/100 g (e.g., about 100 to 300 ml/100 g). Incidentally, the oil absorption is a value measured with the use of a linseed oil according to JIS K 5107.

Moreover, a specific surface area of the first hot-melt adhesive fine particle is about 5 to 100 $m^2/g$ (e.g., about 10 to 50 $m^2/g$), preferably about 10 to 40 $m^2/g$.

The hot-melt adhesive fine particle which satisfies the above characteristics is a porous hot-melt adhesive fine particle.

The hot-melt adhesive resin includes a variety of resins, for example, olefinic resins (e.g., a polyethylene, an ethylene-propylene copolymer, an atactic polypropylene), ethylene copolymer resins [e.g., an ethylene-vinyl acetate copolymer, an ethylene-(meth)acrylic acid copolymer, ethylene-ethyl (meth)acrylate copolymer, an ionomer], nylon-series resins, polyester-series resins, polyurethane-series resins, acrylic resins, rubbers and the like. These hot-melt adhesive resins may be used singly or in combination. The hot-melt adhesive resin is usually water-insoluble. The hot-melt adhesive resin may be a reactive hot-melt adhesive resin having a reactive group (e.g., a carboxyl group, a hydroxyl group, an amino group, an isocyanate group, a silyl group) at terminal position.

The preferred resin for imparting the thermal-transferability and durability (e.g., washing resistance) is a nylon-series resin, a polyester-series resin, a polyurethane-series resin or the like. In particular, when an image-receiving material is clothes or the like, a hot-melt adhesive resin composed of a nylon-series resin can provide a transfer image with excellent washing resistance and water resistance, and superior texture.

As the nylon-series hot-melt adhesive resins, there may be mentioned nylon 6, nylon 46, nylon 66, nylon 610, nylon 612, nylon 11, nylon12, a polyamide resin formed by reacting a dimer acid with a diamine, a polyamide-series elastomer (e.g., a polyamide with polyoxyalkylene diamine as a soft segment). These nylons may be used singly or in combination. Among them, the preferred nylon includes a nylon having at least one unit selected from nylon 11 and nylon 12 (e.g., a homopolyamide such as nylon 11 and nylon 12, a copolyamide such as nylon 6/11, nylon 6/12, nylon 66/12, a copolymer of a dimer acid, a diamine and laumlactam or aminoundecanoic acid), a polyamide resin formed by reacting a dimer acid and a diamine.

The polyester-series hot-melt adhesive resin includes a homopolyester resin, a copolyester resin and a polyester-series elastomer, which employ at least an aliphatic diol or an aliphatic dicarboxylic acid. The homopolyester resin includes a saturated aliphatic polyester resin formed by reacting an aliphatic diol (e.g., $C_{2-10}$alkylene diol such as ethylene glycol, propylene glycol, 1,4-butanediol, 1,6-hexanediol, polyoxy$C_{2-4}$alkylene glycol such as diethylene glycol), an aliphatic dicarboxylic acid (e.g., $C_{4-14}$aliphatic dicarboxylic acid such as adipic acid, suberic acid, azelaic acid, sebacic acid, and dodecanedicarboxylic acid), and if necessary, lactone (e.g., butyrolactone, valerolactone, caprolactone and laurolactone). The copolyester resin includes a saturated polyester resin obtained by substituting a part of components constituting a polyethylene terephthalate or a polybutylene terephthalate (a diol component and/or a terephthalic acid) with the other diols (e.g., $C_{2-6}$alkylene glycol such as ethylene glycol, propylene glycol, and 1,4-butanediol, polyoxyalkylene glycol such as diethylene glycol and triethylene glycol, cyclohexanedimethanol) or the other dicarboxylic acids (e.g., the above aliphatic dicarboxylic acid, an asymmetric aromatic dicarboxylic acid such as phthalic acid and isophthalic acid), or the above lactones. The polyester-series elastomer includes an elastomer having $C_{2-4}$alkylene arylate (e.g., ethylene terephthalate, buthylene terephthalate) as a hard segment and (poly)oxyalkylene glycol as a soft segment. A polyester resin having an urethane bond, for example, a resin in which its molecular weight is increased with the use of the diisocyanate may be employed as the polyester-series resin. These polyesters can be used singly or in combination.

The polyurethane-series hot-melt adhesive resin includes a polyurethane resin obtained with the use of, as at least one part of diol component, the polyester diol corresponding to the polyester-series hot-melt adhesive resin. An aromatic, an araliphatic, an alicyclic or an aliphatic diisocyanate is used as the diisocyanate component. These polyurethanes can be used singly or in combination.

The melting point of the first hot-melt adhesive fine particle can be usually selected within the range of about 50 to 250° C. (e.g., about 70 to 250° C.), preferably about 60 to 200° C. (e.g., about 80 to 200° C.), and more preferably about 70 to 150° C. (e.g., about 100 to 150° C.).

In order to give the hot-melt adhesiveness by protruding the first hot-melt adhesive fine particle from the transfer layer surface, the first hot-melt adhesive fine particle may comprise a powdered resin having a larger average particle size than the thickness of the transfer layer. The average particle size of the nylon fine particle is, for example, about 1 to 100 $\mu$m, preferably about 3 to 80 $\mu$m, and more preferably about 5 to 50 $\mu$m.

(2) The Second Hot-melt Adhesive Fine Particle

The transfer layer may further comprise a second hot-melt adhesive fine particle having an oil absorption of less than 50 ml/100 g (e.g., about 0 to 48 ml/100 g, preferably about 10 to 47 ml/100 g) for the purpose of imparting the high hot-melt adhesiveness.

The species and melting point of the hot-melt adhesive resin, and the average particle size of the fine particle in the second hot-melt adhesive fine particle are similar to that of the first hot-melt adhesive fine particle hot-melt adhesive.

The ratio (weight ratio) of the first hot-melt adhesive fine particle to the second hot-melt adhesive fine particle is the former/the latter=about 10/90 to 90/10 (e.g., about 20/80 to 60/40), preferably about 10/90 to 50/50, more preferably about 10/90 to 40/60 (in particular, about 10/90 to 30/70).

The amount of the hot-melt adhesive particle is, on solid basis, about 10 to 10,000 parts by weight (e.g., about 10 to 5,000 parts by weight), preferably about 10 to 3,000 parts by weight (e.g., about 10 to 2,000 parts by weight), more preferably about 100 to 1,000 parts by weight (e.g., about 150 to 1,000 parts by weight), and usually about 150 to 5,000 parts by weight relative to 100 parts by weight of the film-forming resin component.

(Film-forming Resin Component)

The film-forming resin component is not particularly limited as far as it has the film-forming properties, a variety of thermoplastic resins (e.g., polyamide-series resins, polyester-series resins, styrenic resins, polyolefinic resins, cellulose derivatives, polycarbonate-series resins, polyvinyl acetate-series resins, acrylic resins, vinyl chloride-series resins, thermoplastic urethane-series resins) and thermosetting resins can be used. Among these film-forming resin components, at least one selected from the group consisting of a hydrophilic polymer, an urethane-series resin, and a thermosetting or a crosslinking resin is preferred. These film-forming resin components can be used singly or in combination.

(1) The Hydrophilic Polymer

The transfer layer may contain a hydrophilic polymer in order to make an ink retainability better.

The hydrophilic polymer includes a variety of polymers having an affinity for water, for example, a water-soluble polymer, a water-dispersable polymer, and a polymer which is water-insoluble and has water-absorbing.

As the hydrophilic polymer, there may be mentioned, for example, polyoxyalkylene glycol-series resins (polyoxy-$C_{2-4}$alkylene glycol such as polyethylene glycol, polypropylene glycol, ethylene oxide-propylene oxide block copolymer, and polytetramethylene ether glycol), acrylic polymers [e.g., poly(meth)acrylic acid or a salt thereof, methyl methacrylate-(meth) acrylic acid copolymer, acrylic acid-polyvinylalcohol copolymer], vinyl ether-series polymers (e.g., polyvinyl alkyl ethers such as polyvinyl methyl ether and polyvinyl isobutyl ether, $C_{1-6}$alkyl vinyl ether-maleic anhydride copolymer), styrenic polymers [e.g., styrene-maleic anhydride copolymer, styrene-(meth)acrylic acid copolymer, polystyrenesulfonic acid or a salt thereof], vinyl acetate-series polymers (e.g., vinyl acetate-(meth) acrylic acid copolymer, vinyl acetate-methyl acrylate copolymer), vinyl alcohol-series polymer (polyvinyl alcohol, a modified polyvinyl alcohol, ethylene-vinyl alcohol copolymer), cellulose derivatives (e.g., a cellulose ether such as methyl cellulose, ethyl cellulose, hydroxyethyl cellulose, and carboxymethyl cellulose, a cellulose ester such as cellulose acetate), hydrophilic natural polymers or derivatives thereof (e.g., alginic acid or a salt thereof, gum arabic, gelatin, casein, dextrin), nitrogen-containing polymers (or cationic polymers) or salts thereof [e.g., quaternary ammonium salts such as polyvinylbenzyltrimethylannmonium chloride, and polydiallyldimethylammonium chloride, polydimethylaminoethyl (meth)acrylate hydrochloride, polyvinylpyridine, polyethylene imine, polyacryl amide, polyvinyl pyrrolidone]. The salt of the hydrophilic polymer (in particular, a salt of carboxyl group or sulfonic acid group) includes an ammonium salt, an amine salt, an alkali metal salt such as sodium salt. These hydrophilic polymers can be used singly or in combination.

Among the hydrophilic polymers, hydroxyl group-containing hydrophilic polymers [for example, polyoxyalkylene glycol-series resins, vinyl alcohol-series polymers (polyvinyl alcohol, a modified polyvinyl alcohol), cellulose derivatives (e.g., hydroxyethylcellulose)], carboxyl group-containing hydrophilic polymers (e.g., an acrylic polymer), nitrogen-containing polymers (e.g., cationic polymers, polyvinylpyrrolidone), in particular, polyoxyalkylene glycol-series resins are preferred. As polyoxyalkylene glycol-series resins, polyoxyalkylene glycol-series resins having an oxyethylene unit is preferred, and for example, there may be mentioned polyethylene glycol (homopolymer), or a copolymer of ethylene oxide with at least one selected from the group consisting of $C_{3-4}$alkylene oxide, a hydroxyl group-containing compound (e.g., polyhydric alcohols such as glycerin, trimethylolpropane, trimethylolethane and bisphenol A), a carboxyl group-containing compound (e.g., $C_{2-4}$carboxylic acids such as acetic acid, propionic acid, butyric acid) and an amino group-containing compound (e.g., amine, ethanolamine). The weight-average molecular weight of the hydrophilic polymer is about 100 to 50,000, preferably about 500 to 10,000, more preferably about 1,000 to 5,000.

(2) Urethane-series Resins

The transfer layer may further contain urethane-series resins for excellent texture (softness).

Urethane-series resin comprises, for example, a urethane-series polymer obtained by reacting a diisocyanate component with a diol component, and if necessary, a diamine component may be used as a chain-extending agent.

As the diisocyanate component, there may be mentioned aromatic diisocyanates (e.g., phenylene diisocyanate, tolylene diisocyanate, diphenylmethane-4,4'-diisocyanate), an araliphatic diisocyanates (e.g., xylylene diisocyanate), alicyclic diisocyanates (e.g., isophorone diisocyanate), aliphatic diisocyanates (e.g., 1,6-hexamethylene diisocyanate, lysine diisocyanate). Adducts of a diisocyanate compound may be used as the diisocyanate component. If necessary, polyisocyanates such as triphenyl methane triisocyanate may be used in combination. The diisocyanate component may be used singly or in combination.

As examples of the diol component, there may be mentioned polyester diols, polyether diols, polycarbonate diols. The diol components may be used singly or in combination.

The polyester diol may be a polyester diol derived from a lactone, not being limited to polyester diols obtained by reaction with a diol and a dicarboxylic acid or reactive derivatives thereof (e.g., lower alkyl ester, acid anhydride). As examples of the diol, there may be mentioned aliphatic diols (e.g., $C_{2-10}$alkylene diol such as ethylene glycol, trimethylene glycol, propylene glycol, 1,3-butanediol, 1,4-butanediol, hexamethylene glycol, neopentyl glycol; polyoxy$C_{2-4}$alkylene glycol such as diethylene glycol, triethylene glycol), alicyclic diols and aromatic diols. The diols may be used singly or in combination. If necessary, polyols such as trimethylol propane and pentaerythritol may be used in combination with the above diol. The diols is usually an aliphatic diol.

As examples of the dicarboxylic acid, there may be mentioned aliphatic dicarboxylic acids (e.g., aliphatic $C_{4-14}$aliphatic dicarboxylic acids such as adipic acid, suberic acid, azelaic acid, sebacic acid, dodecanedicarboxylic acid), alicyclic dicarboxylic acids, aromatic dicarboxylic acids (e.g., phthalic acid, terephthalic acid, isophthalic acid). The dicarboxylic acid may be used singly or in combination. If necessary, polycarboxylic acid such as trimellitic acid and pyromelitic acid may be used in combination with the dicarboxylic acid.

As examples of the lactone, there may be mentioned butyrolactone, valerolactone, caprolactone and laurolactone. The lactones may be used singly or in combination.

The urethane-series resin may be a polyether-type urethane-series resin obtained with the use of a polyether diol (e.g., polyoxytetramethyleneglycol) as a diol component, but a polyester-type urethane-series resin obtained with the use of at least a polyester diol (in particular, an aliphatic polyester diol obtained with use of an aliphatic component as a main reaction component), for example, a urethane resin obtained by reacting a diisocyanate such as isophorone diisocyanate with a polyester diol, which is obtained by reacting a $C_{2-6}$alkylene diol such as 1,4-butandiol with a $C_{4-12}$aliphatic dicarboxylic acid such as adipic acid and isophthalic acid or phthalic acid, or a polyester diol, which is derived from the above lactone, is preferred.

It is preferred that the urethane-series resin is used as an organic solvent solution, an aqueous solution, an aqueous emulsion. The aqueous solution or the aqueous emulsion of the urethane-series resin may be prepared by dissolving or emulsion-dispersing a urethane-series resin with the use of an emulsifying agent, or by introducing a ionic functional group such as a free carboxyl group and a tertiary amino group into a molecule of a urethane-series resin and dissolving or dispersing the urethane-series resin with the use of an alkali or an acid. Such an urethane-series resin in which a free carboxyl group or a tertiary amino group is introduced into its molecule comprises an urethane-series resin obtained by reacting a diisocyanate component with a diol component having a free carboxyl group or a tertiary amino group (in particular, a polymeric diol). Incidentally, the diol having a free carboxyl group (in particular, a polymeric diol) can be obtained by a process which comprises reacting a diol component with a polycarboxylic acid or an anhydride thereof having three or more carboxyl groups (e.g., a tetrabasic acid anhydride such as pyromellitic acid anhydride) or polybasic carboxylic acid having a sulfonic acid group (e.g., sulfoisophthalic acid), or a process which comprises ring-opening-polymerizing a lactone with the use of dimethylol propionic acid as an initiator. Moreover, the diol having a tertiary amino group (especially, a polymeric diol) can be prepared by ring-opening-polymerizing an alkyleneoxide or a lactone with the use of N-methyldiethanolamine or the like as an initiator. The tertiary amino group may form a quaternary ammonium salt. Such an urethane-series polymer in which a tertiary amino group or a quaternary ammonium salt is introduced [a cation-type urethane-series resin (cationic urethane-series resin)] is commercial available as, for example, F-8559D (manufactured by Daiichi Kogyo Seiyaku, Co. Ltd.), PERMARIN UC-20 (manufactured by Sanyo Kasei Kogyo, Co. Ltd.). The urethane-series resins may be used singly or in combination.

(3) Thermosetting Resin or Crosslinking Resin

A thermosetting resin or a crosslinking resin may be, for example, a phenolic resin, an alkyd resin, an unsaturated polyester resin, an epoxy-series resin, a vinyl ester-series resin, silicone-series resin or the like, but a self-crosslinking resin (a thermoplastic resin having a self-crosslinking group), for example, a self-crosslinking polyester-series resin, a self-crosslinking polyamide-series resin, a self-crosslinking acrylic resin, a self-crosslinking olefinic resin and the like are preferred. Among them, a self-crosslinking acrylic resin (e.g., an acrylic silicone resin) is particularly preferred.

The self-crosslinking (self-crosslinkable) resin comprises a polymer composed of a monomer having at least a self-crosslinking group [e.g., epoxy group, methylol group, a hydrolyzed condensate group (e.g., silyl group), aziridinyl group] as a constituting unit.

A monomer having the self-crosslinking group (i.e., a crosslinking functional group-containing monomer) includes a variety of monomers, for example, epoxy group-containing monomers [e.g., glycidyl (meth)acrylate, (meth)

allyl glycidyl ether, 1-allyloxy-3,4-epoxybutane, 1-(3-butenyloxy)-2,3-epoxypropane, 4-vinyl-1-cyclohexane-1,2-epoxide], a methylol group-containing monomers or derivatives thereof [e.g., N-$C_{1-4}$alkoxymethyl (meth) acrylamide such as N-methylol (meth)acrylamide, and N-methoxymethyl (meth)acrylamide, N-butylol (meth) acrylamide], a monomer containing a hydrolyzed condensate group such as silyl group [e.g., vinyltrimethoxysilane, vinyltriethoxysilane, vinyltributoxysilane, vinylmethoxydimethylsilane, vinylethoxydimethylsilane, vinylisobutoxydimethylsilane, vinyldimethoxymethylsilane, vinyldiethoxymethylsilane, vinyltris(2-methoxyethoxy) silane, vinyldiphenylethoxysilane, vinyltriphenoxysilane, 3-(vinylphenylaminopropyl)trimethoxysilane, 3-(vinylbenzylaminopropyl)trimethoxysilane, 3-(vinylphenylaminopropyl)triethoxysilane, 3-(vinylbenzylaminopropyl)triethoxysilane, divinyldimethoxysilane, divinyldiethoxysilane, divinyldi(2-methoxyethoxy)silane, vinyldiacetoxymethylsilane, vinyltriacetoxysilane, vinylbis(dimethylamino) methylsilane, vinylmethyldichlorosilane, vinyldimethylchlorosilane, vinyltrichlorosilane, vinylmethylphenylchlorosilane, allyltriethoxysilane, 3-allylaminopropyltrimethoxysilane, allyldiacetoxymethylsilane, allyltriacetoxysilane, allylbis(dimethylamino) methylsilane, allylmethyldichlorosilane, allyldimethylchlorosilane, allyltrichlorosilane, methallylphenyldichlorosilane, 2-(meth) acryroxyethyltrimethoxysilane, 2-(meth) acryroxyethyltriethoxysilane, 3-(meth) acryroxypropyltrimethoxysilane, 3-(meth) acryroxypropyltriethoxysilane, 3-(meth) acryroxypropylmethyldimethoxysilane, 3-(meth) acryroxypropylmethyldichlorosilane, 3-(meth) acryroxypropyltris(2-methoxyethoxy)silane], aziridinyl group-containing monomer [e.g., 2-(1-aziridinyl)ethyl (meth)acrylate, 2-(1-aziridinyl)propyl (meth)acrylate, 3-(1-aziridinyl)propyl (meth)acrylate]. The monomer containing a crosslinking functional groups can be used singly or in combination.

The preferred monomer containing a crosslinking functional group has a hydrolyzed condensate group, in particular, alkoxysilyl group (e.g., $C_{1-4}$alkoxy silyl groups such as methoxysilyl group, ethoxysiliyl group). An acrylic resin having the above hydrolyzed condensate group are preferred as the thermosetting or crosslinking resin.

The thermosetting or crosslinking resin may comprise the monomer containing a crosslinking functional group and the other monomers (e.g., monomers such as monomers containing a cationic functional group, hydrophilic monomers, nonionic monomers).

As a monomer containing a cationic functional group, there may be mentioned, for example, di$C_{1-4}$alkylamino-$C_{2-3}$alkyl(meth)acrylamides or salts thereof [e.g., dimetylaminoethyl(meth)acrylamide, dietylaminoethyl (meth)acrylamide, dimethylaminopropyl(meth)acrylamide, dietylaminopropyl(meth)acrylamide], di$C_{1-4}$alkylamino-$C_{2-3}$alkyl(meth)acrylates or salts thereof [e.g., dimethylaminoethyl(meth)acrylate, diethylaminoethyl (meth)acrylate, dimethylaminopropyl(meth)acrylate, diethylaminopropyl (meth)acrylate], di$C_{1-4}$alkylamino-$C_{2-3}$alkyl group-substituted aromatic vinyls or salts thereof [e.g., 4-(2-dimethylaminoethyl)styrene, 4-(2-dimethylaminopropyl)styrene], a nitrogen-containing heterocyclic monomers or salts thereof [e.g., vinylpyridine, vinylimidazole, vinylpyrrolidone]. As a salt, there may be mentioned a hydrohalogenic acid salt (e.g., hydrochloride, hydrobromide), a sulfate, an alkylsulfate (e.g., methylsulfate, ethylsulfate), an alkylsulfonate, an arylsulfonate, a carboxylate (e.g., acetate). Incidentally, a quaternary ammonium salt group may be formed by reacting a tertiary amino group with an alkylating agent (e.g., epichlorohydrin, methyl chloride, benzyl chloride).

The cationic monomer (e.g., a monomer having a tertiary amino group, or a salt group thereof, a monomer having or capable of forming a quaternary ammonium salt group) is employed in a cationic polymer (a crosslinking polymer) having a crosslinking group obtained by copolymerizing with the monomer containing a crosslinking functional group to improve fixability and water resistance.

The hydrophilic monomer includes a copolymerizable monomer having a hydrophilic group such as carboxyl group, acid anhydride group, hydroxyl group, amido group, sulfonic acid group, ether group, polyoxyalkylene group and the like.

As the carboxyl group-containing monomer, there may be mentioned unsaturated carboxylic acids or acid anhydrides thereof such as (meth)acrylic acid, itaconic acid, maleic acid, maleic anhydride, fumaric acid, and crotonic acid, and salts thereof (e.g., alkali metal salts, alkaline earth metal salt, ammonium salts, amine salts), half-esters of a polybasic unsaturated carboxylic acid or a acid anhydride thereof with a linear or branched alcohol having about 1 to 20 carbon atoms (e.g., monomethyl malate, monoethyl malate, mono2-ethylhexyl malate).

As a hydroxyl group-containing monomer, there may be mentioned a hydroxyalkyl ester of an unsaturated fatty acid [e.g., a hydroxyhydroxy$C_{2-6}$alkyl ester of a carboxylic acid, for example, a hydroxy$C_{2-6}$alkyl (meth)acrylate such as 2-hydroxyethyl (meth)acrylate, 2-hydroxypropyl (meth) acrylate, 3-hydroxypropyl (meth)acrylate, 4-hydroxybutyl (meth)acrylate, mono- or dihydroxy$C_{2-6}$alkyl malate such as 2-hydroxyethylmethyl malate, di(2-hydroxypropyl) malate], an aliphatic, alicyclic, or aromatic vinyl compound having a hydroxyl group (e.g., α-hydroxystyrene).

As an amido group-containing monomer, there may be mentioned $C_{2-8}$carboxylic amide which may be substituted with a substituent such as a $C_{1-4}$alkyl group, $C_{1-4}$alkoxy group, $C_{1-4}$acyl group and the like [e.g., a (meth)acrylamide such as (meth)acrylamide, α-ethyl(meth)acrylamide, N-methyl(meth)acrylamide, N-butoxymethyl(meth) acrylamide, diacetone (meth)acrylamide].

As sulfonic acid group-containing monomer, there may be mentioned such as an aliphatic, alicyclic, or aromatic vinyl compound having a sulfonic acid group such as styrene-sulfonic acid and vinylsulfonic acid, or sodium salt thereof.

As an ether group-containing monomer, there may be mentioned a vinyl ether such as vinyl methyl ether, vinyl ethyl ether, and vinyl isobutyl ether.

As a polyoxyalkylene group-containing monomer, there may be mentioned diethylene glycol mono(meth)acrylate, triethylene glycol mono(meth)acrylate, polyethylene glycol mono(meth)acrylate.

These hydrophilic monomers can be used singly or in combination.

The preferred hydrophilic monomer includes a carboxyl group-containing monomer, in particular, a (meth)acrylic acid or its salt (e.g., sodium salt, potassium salt), a hydroxyl group-containing monomer [e.g., 2-hydroxylethyl (meth) acrylate, hydroxypropyl (meth)acrylate], a polyoxyalkylene unit-containing monomer [e.g., diethylene glycol mono (meth)acrylate, triethylene glycol mono(meth)acrylate, polyethylene glycol mono(meth)acrylate].

The crosslinking functional group-containing monomer, the cationic functional group-containing monomer and the hydrophilic monomer can be used in combination.

These monomers may be used in combination with a nonionic monomer in order to adjust the film-formability and film-forming properties.

As a nonionic monomer, there may be mentioned, for example, an alkyl ester [e.g., $C_{1-18}$alkyl ester of (meth) acrylic acid such as methyl (meth)acrylate, ethyl (meth) acrylate, propyl (meth)acrylate, isopropyl (meth)acrylate, n-butyl (meth)acrylate, isobutyl (meth)acrylate, t-butyl (meth)acrylate, hexyl (meth)acrylate, octyl (meth)acrylate, 2-ethylhexyl (meth)acrylate, lauryl (meth)acrylate, and stearyl (meth)acrylate], a cycloalkyl ester [e.g., cyclohexyl (meth)acrylate], an aryl ester [e.g., phenyl (meth)acrylate], an aralkyl ester [e.g., benzyl (meth)acrylate], an aromatic vinyl compound [e.g., styrene, vinyl toluene, α-methyl styrene], a vinyl ester [e.g., vinyl acetate, vinyl propionate, vinyl versatate], an allyl ester [e.g., allyl acetate], a halogen-containing monomer [e.g., vinylidene chloride, vinyl chloride], vinyl cyanide [e.g., (meth)acrylonitrile], an olefinic compound [e.g., ethylene, propylene].

These nonionic monomers can be used singly or in combination.

As the nonionic monomer, a $C_{1-18}$alkyl ester of (meth) acrylic acid [in particular, a $C_{2-10}$alkyl ester of acrylic acid, a $C_{1-6}$alkyl ester of methacrylic acid], an aromatic vinyl compound [in particular, styrene], a vinyl ester [in particular, vinyl acetate].

The thermosetting or crosslinking resin may comprise a copolymer of the crosslinking functional group-containing monomer and if necessary, at least one monomer selected from the group consisting of the cationic functional group-containing monomer, the hydrophilic monomer and the nonionic monomer (in particular, the cationic functional group-containing monomer). Preferably, the thermosetting or crosslinking resin may be a copolymer of the crosslinking functional group-containing monomer and the cationic functional group-containing monomer, and further, at least one monomer selected from the group consisting of the hydrophilic monomer and the nonionic monomer (in particular, the hydrophilic monomer).

The preferred combinations of the monomers are as follows:

Crosslinkable monomer: a silyl group-containing (meth) acrylate, for example, (meth)acryloyloxy-$C_{2-3}$alkyltri-$C_{1-2}$alkoxysilane Cationic functional group-containing monomer: di$C_{1-4}$ alkylamino-$C_{2-3}$alkyl(meth)acrylate or a quaternary ammonium salt thereof Hydrophilic monomer: unsaturated carboxylic acid A polymerization manner of a copolymer composed of the above monomers is not particularly limited, and may be for example, a random copolymer.

In the total monomers, the amount of the crosslinking functional group-containing monomer is about 0.1 to 20% by weight, preferably about 0.1 to 10% by weight, and more preferably about 1 to 5% by weight, and the amount of the cationic functional group-containing monomer is about 1 to 50% by weight, preferably about 5 to 45% by weight, and the amount of the hydrophilic monomer is about 0 to 30% by weight (e.g., about 0.1 to 30% by weight), preferably about 0.1 to 20% by weight, and more preferably about 0.5 to 15% by weight, and the balance comprises a nonionic monomer.

In the preferred embodiment, as to the amount of the monomers, the amount of the cationic functional group-containing monomer is about 300 to 1,000 parts by weight, preferably about 500 to 800 parts by weight, and the amount of the hydrophilic monomer is about 100 to 500 parts by weight, preferably about 200 to 300 parts by weight relative to 100 parts by weight of the crosslinking functional group-containing monomer.

The form of the thermosetting or crosslinking resin may be a solution such as an organic solvent solution and an aqueous solution, but is usually an emulsion form (in particular, an aqueous solution). An emulsion containing a crosslinking polymer can be obtained by a conventional method, for example, a process which comprises emulsion polymerizing the monomers in the emulsion-polymerization system containing a nonionic surfactant and/or a cationic surfactant, or a process which comprises polymerizing the monomers followed by forming a tertiary amine salt or a quaternary ammonium salt to obtain an aqueous emulsion.

Incidentally, the thermosetting or crosslinking resin, the urethane-series resin and the hydrophilic polymer may be employed in combination, for example, by previously mixing them. Moreover, the thermosetting or crosslinking resin and the urethane-series resin may be used in complex by a process which comprises emulsion polymerizing a monomer containing an acrylic monomer (in particular, a cationic monomer) in the presence of an urethane-series resin emulsion. The thermosetting or crosslinking resin can be used singly or in combination.

Further, it is preferred that the hydrophilic polymer and the urethane-series resin are employed in combination. The ratio (weight ratio) of the both sides is the hydrophilic polymer/the urethane-series resin=about 90/10 to 10/90, preferably about 70/30 to 30/70, and more preferably about 60/40 to 40/60.

(Dye Fixing Agent)

Further, the transfer layer may contain a cationic compound (dye fixing agent having a low molecular weight) or a polymeric dye fixing agent as a dye fixing agent in order to improve a fixability of a coloring agent (dye). In particular, in the film-forming resin component, when a cationic monomer is not introduced to the resin, it is preferred that a dye fixing agent is employed. These dye fixing agents can be used singly in combination. Among these dye fixing agents, a cationic compound, in particular, a quaternary ammonium salt are preferred.

(1) Cationic Compound

The cationic compound includes an aliphatic amine salt, a quaternary ammonium salt (e.g., an aliphatic quaternary ammonium salt, an aromatic quaternary ammonium salt, a heterocyclic quaternary ammonium salt). These cationic compounds can be used singly or in combination. Among them, the preferred cationic compound includes an aliphatic quaternary ammonium salt (e.g., a tetra$C_{1-6}$alkylammonium halide such as tetramethylammonium chloride, tetraethylammonium chloride, tetramethylammonium bromide and tetraethylammonium bromide, tri$C_{1-6}$alkyl$C_{8-20}$ alkylammonium halide such as trimethyllaurylammonium chloride and trimethyllaurylammonium bromide, di$C_{1-6}$alkyldi-$C_{8-20}$alkylammonium halide such as dimethyldilaurylammonium chloride and dimethyldilaurylammonium bromide), especially tetra$C_{1-4}$alkylammonium halide (e.g., tetra $C_{1-2}$alkylammonium halide), tri$C_{1-4}$alkyl-$C_{10-16}$alkylammonium halide (e.g., tri$C_{1-2}$alkyl-$C_{10-14}$alkylammonium halide), di$C_{1-4}$alkyldi-$C_{10-16}$alkylammonium halide (e.g., di$C_{1-2}$alkyldi-$C_{10-14}$alkylammonium halide). The aliphatic amine salt is commercial available, for example, as ACKTECHS FC-7 (manufactured by MORIN CHEMICAL, Co. Ltd.) and the like, and the quaternary ammonium salt is commercial available, for example, as CATIOGEN L (manufactured by Daiichi Kogyo Seiyaku, Co. Ltd.).

(2) Polymeric Dye Fixing Agent

The polymeric dye fixing agent usually has a cationic group (in particular, a strong cationic group such as a guanidyl group and a quaternary ammonium salt group) in its molecule.

As the polymeric dye fixing agent, there may be mentioned, for example, a dicyane-series compound (e.g., dicyanediamide-formaldehyde polycondensate), a polyamine-series compound [e.g., an aliphatic polyamine such as diethylenetriamine, an aromatic polyamine such as phenylenediamine, a condensate of dicyandiamide and (poly)$C_{2-4}$alkylenepolyamine (e.g., dicyanediamide-diethylenetriamine polycondensate)], polycationic compound. As polycationic compound, there may be mentioned, for example, an epichlorohydrine-di$C_{1-4}$alkylamine addition polymer (e.g., an addition polymer of an epichlorohydrine-dimethylamine), a polymer of an allylamine or its salt (e.g., a polymer of an allylamine or its salt, a polymer of a polyallylamine or its hydrochloride), a polymer of a diallyl$C_{1-4}$alkylamine or its salt (e.g., a polymer of a diallylmethylamine or its salt), a polymer of a diallyldi-$C_{1-4}$alkylammonium salt (e.g., a polymer of a diallyldimethylammonium chloride), a copolymer of a diallylamine or its salt with a sulfur dioxide (e.g., diallylamine salt-sulfur dioxide copolymer), a diallyldi$C_{1-4}$alkylammonium salt-sulfur dioxide copolymer (e.g., diallyldimethylammonium salt-sulfur dioxide copolymer), a copolymer of a diallyldi-$C_{1-4}$alkylammonium salt with a diallylamine or its salt, or its derivative (e.g., a copolymer of a diallyldimethylammonium salt-diallylamine hydrochloride derivative), a diallyldi-$C_{1-4}$alkylammonium salt polymer (e.g., diallyldimethylammonium salt polymer), dialkylaminoethyl(meth)acrylate quaternary salt polymer [e.g., di$C_{1-4}$alkylalkylaminoethyl (meth)acrylate quaternary salt polymer], a diallyldi-$C_{1-4}$alkylammonium salt-acrylamide copolymer (e.g., diallyldimethylammonium salt-acrylamide copolymer), an amine-carboxylic acid copolymer and the like. These polymeric dye fixing agent can be used singly or in combination.

The ratio of the dye fixing agent is, on solid basis, about 1 to 200 parts by weight (e.g., about 1 to 50 parts by weight), preferably about 5 to 150 parts by weight (e.g., about 5 to 40 parts by weight), more preferably about 10 to 100 parts by weight (e.g., about 10 to 30 parts by weight), and usually about 10 to 60 parts by weight relative to 100 parts by weight of the film-forming resin component.

(Additives)

If necessary, the transfer layer may contain a variety of additives, for example, the other dye fixing agents, stabilizers (e.g., antioxidants, ultraviolet ray absorber, thermal stabilizer), antistatic agent, flame retardants, lubricants, antiblocking agents, fillers, coloring agents, antifoaming agents, coatability improving agents, thickeners and the like. The hot-melt adhesive fine particle may contain adhesion imparting agents (e.g., rosin or its derivative, hydrocarbon-series resins), waxes and the like beside the above additives.

The coating amount of the transfer layer is about 1 to 100 g/m$^2$, preferably about 10 to 60 g/m$^2$ and more preferably about 10 to 50 g/m$^2$ (e.g., about 20 to 40 g/m$^2$). The thickness of the transfer layer is about 5 to 90 $\mu$m, preferably about 10 to 70 $\mu$m, and usually about 5 to 60 $\mu$m (in particular, about 10 to 50 $\mu$m). Incidentally, the thickness of the transfer layer means a minimum thickness of the coating layer formed with the use of a coating agent comprising a nylon fine particle.

Moreover, if necessary, a porous layer, an antiblocking layer, a lubricating layer, an antistatic layer and others may be formed on the transfer layer.

[Protecting Layer]

In the transfer sheet of the present invention, the protecting layer may be disposed between the support and the transfer layer, and has a role of protecting the transfer sheet after transferring on the image-receiving material. In particular, washing resistance is dramatically improved by disposing the protecting layer.

As the protecting layer, a variety of thermoplastic resins and thermosetting resins, in particular, a polymer having film-forming properties (especially, a polymer having non-adhesiveness, flexibility and suppleness) can be employed as far as the protecting layer is capable of separating from the support and protecting the transfer layer, and the quality of a transfer image does not deteriorate. As the thermoplastic resin, there may be mentioned a variety of resins such as polyamide-series resins, polyester-series resins, styrenic resins, polyolefinic resins, polycarbonate-series resins, polyvinyl acetate-series resins, acrylic resins, vinyl chloride-series resins, and thermoplastic urethane-series resins. As the thermosetting resin, there may be mentioned urethane-series resins, epoxy-series resins, phenolic resins, melamine-series resins, urea resins, and silicone-series resins. Among these resins, urethane-series resins (e.g., the above thermoplastic urethane-series resins) and/or cationic resins, in particular, cationic thermoplastic urethane-series resins are preferred since such resins have high wettability or compatibility toward a support and protect the transfer layer efficiently.

As the urethane-series resin, the above exemplified resins can be employed, and as the thermoplastic urethane-series resin, a polyester-type urethane-series resins obtained with the use of at least a polyester diol as a diol component, especially, a polyester-type urethane-series resin obtained with the use of a diol component containing not less than 50% by weight (e.g., not less than 75% by weight) of an aliphatic polyester diol are preferred. Moreover, if necessary, urethane-series resin may be used as a thermoplastic elastomer obtained with the use of a diamine component which is employed as a chain-extending agent. As the thermoplastic urethane-series elastomer, for example, there may be mentioned an elastomer containing an aliphatic polyether and polyester as a soft segment and a polyurethane unit of a short-chain glycol as a hard segment. As the cationic thermoplastic urethane-series resin, there may be mentioned an urethane-series resins incorporated with the above exemplified tertiary amino group or the quaternary ammonium salt.

The coating amount of the protecting layer is about 0.1 to 20 g/m$^2$, preferably about 1 to 10 g/m$^2$ and more preferably about 1 to 7 g/m$^2$. The thickness of the protecting layer is about 0.1 to 10 $\mu$m, preferably about 1 to 5 $\mu$m.

[Production Process]

The transfer sheet of the present invention can be produced by forming the transfer layer on at least one side of the support. The transfer layer can be formed by coating a release surface of the support with a coating agent comprising a hot-melt adhesive particle, a film-forming resin component, and if necessary other components (e.g., dye fixing agent). The film-forming resin component can be usually used in the form of an aqueous solution or an emulsion. Therefore, a coating agent for a transfer layer can be prepared by mixing an aqueous solution or emulsion containing a film-forming resin component, a hot-melt adhesive particle, and if necessary, the other components. A solvent for an aqueous solution or an aqueous emulsion may be water only, or may optionally contain a hydrophilic organic solvent such as an alcohol.

When a protecting layer is formed, the transfer layer can be formed by coating a release surface of the support with a coating agent for a protecting layer comprising an urethane-series resin and the like, if necessary drying to form the protecting layer, and further by coating the protecting layer with the coating agent for the transfer layer.

The coating agent can be applied on at least one side of the support by a conventional method such as roller coating, air knife coating, blade coating, rod coating, bar coating, comma coating or graver coating. The coat layer can be formed by drying on a temperature of about 50 to 150° C. (preferably about 80 to 120° C.).

The transfer layer formed by the above method is suitable for forming an image by an ink jet printing system which comprises ejecting droplets of ink (in particular, aqueous ink) to record. A record image can be smoothly transferred or conveyed to an image-receiving material by applying an appropriate pressure (e.g., about 500 to 50,000 Pa) at an appropriate temperature (e.g., about 140 to 250° C., preferably about 140 to 200° C.) for an appropriate period (e.g., about 5 seconds to 1 minute) with bringing the transfer layer into contact with the image-receiving material, and peeling the transfer layer or the protecting layer from the support. If necessary, the member having the transfer image may be heated for crosslinking.

As the image-receiving material, there may be mentioned two-dimensional or three-dimensional structures made of various materials such as fibers, papers, woods, plastics, ceramics and metals. Fabrics (e.g., T-shirts), plastic films or sheets, paper, and others may be usually employed as the image-receiving material.

INDUSTRIAL APPLICABILITY

The transfer sheet for an ink jet printer of the present invention is so high ink absorption that the stain transfer does not occur, and is excellent in water resistance and washing resistance. Moreover, a clear image can be maintained for a long term even when thermal-transferring on an image-receiving material such as clothes. Further, the transfer image having excellent texture can be formed.

EXAMPLES

The following examples are intended to describe this invention in further detail and should by no means be interpreted as defining the scope of the invention. Incidentally, unless otherwise indicated, "part(s)" indicates the proportion by weight. Moreover, the transfer sheets obtained in Examples and Comparative Examples were evaluated for various properties according to the following methods.

With the use of an ink jet printer (manufactured by Seiko-Epson, Co. Ltd., PM-770C), on the transfer sheets obtained in Examples and Comparative Examples were individually printed a determined image with cyane, yellow, magenta and black inks to form the record image.

(Stain Transfer)

After printing, whether stain transfer occurs or not was visually evaluated according to the following criteria.

○: No stain transfer

Δ: A slight stain transfer

X: Terrible stain transfer (Washing Resistance)

A record image was thermal-transferred to T-shirts by contacting the record image of a transfer sheet with T-shirts and transferring the record image at a pressure of 40 g/cm$^2$ for 4 minutes with the use of a household iron adjusted to a maximum surface temperature (e.g., "high temperature"). A commercially available T-shirts (made of 100% cotton, L size) was used without any treatments as the T-shirts. The washing operation was carried out with the use of a commercially available automatic washing machine. To a warmed water at 40° C. was added 1 g/L of a commercially available detergent, and washing operation was carried out by washing for 15 minutes, rinsing for 11 minutes and drying for 5 minutes. The washed T-shirts was taken out from the washing machine and drained off the water to dry, and then the transfer image part was observed, and the washing resistance was evaluated according to the following criteria.

○: the transfer image part hardly changes

Δ: the transfer image part discolors

X: the transfer image part disappears

Synthesis Example 1

Preparation of an Acrylic Silicone Resin

To a 2000 mL of a reactor equipped with a stirrer, a reflux condenser, a drip funnel, a nitrogen gas inlet pipe, and a thermometer was charged with 219 parts of isopropyl alcohol, and 1.23 parts of azobisisobutyronitrile, and the charge was dissolved by stirring and heated to 80° C.

As a copolymerization component, 49 parts of hydroxyethyl methacrylate, 94 parts of diethylaminoethyl methacrylate, 5 parts of trimethoxysilanepropyl methacrylate (manufactured by Nippon Unicar, Co. Ltd., A-174), 25 parts of acrylic acid, 37 parts of methyl methacrylate, and 37 parts of n-butyl methacrylate are mixed and the mixture was fed dropwise into the reactor over about 4 hours. After completion of the dropwise addition, a solution mixture of 0.25 part of azobisisobutyronitrile and 25 parts of isopropanol was added dropwise as an additional catalyst, and the reaction was continued for another 2 hours to complete the polymerization reaction.

After completion of the polymerization, 16 parts of acetic acid was fed into the reactor with constant stirring and, thereafter, 705 parts of water was introduced dropwise over about 2 hours. Isopropanol was evaporated off on a rotary evaporator to provide an acrylic silicone resin.

Example 1

An aqueous coating solution was prepared by mixing, on solid basis, 50 parts of a nylon powder (manufactured by Daicel Huels, Co. Ltd., Vestamelt 430-P1, oil absorption of 45 ml/100 g), 20 parts of a porous nylon powder (manufactured by Atochem, Co. Ltd., ORGASOL 3501EX D NAT-1, oil absorption of 212 ml/100 g), 5 parts of an urethane-series resin emulsion (manufactured by Daiichi Kogyo Seiyaku, F-8559D), 20 parts of the acrylic silicone resin obtained in Synthesis Example 1 and 5 parts of an aliphatic amine salt (manufactured by MORIN CHEMICAL, Co. Ltd., ACTEX FC-7). The aqueous coating solution is coated on a clay-coated and silicone-coated paper (thickness of 90 $\mu$m) at coating amount of 30 g/m$^2$ and dried to obtain the transfer sheet.

Example 2

An aqueous coating solution was prepared by mixing, on solid basis, 40 parts of a nylon powder (manufactured by Daicel Huels, Co. Ltd., Vestamelt 430-P1, oil absorption of 45 ml/100 g), 20 parts of a porous nylon powder (manufactured by Atochem , Co. Ltd., ORGASOL 3501EX D NAT-1, oil absorption of 212 ml/100 g), 35 parts of an urethane-series resin emulsion (manufactured by Daiichi Kogyo Seiyaku, F-8559D), and 5 parts of a quaternary ammonium salt (manufactured by Daiichi Kogyo Seiyaku, Co. Ltd., CATIOGEN L). The aqueous coating solution is coated on a clay-coated and silicone-coated paper (thickness of 90 μm) at coating amount of 30 g/m$^2$ and dried to obtain the transfer sheet.

Example 3

An aqueous coating solution was prepared by mixing, on solid basis, 50 parts of a nylon powder (manufactured by Daicel Huels, Co. Ltd., Vestamelt 430-P1, oil absorption of 45 ml/100 g), 20 parts of a porous nylon powder (manufactured by Atochem, Co. Ltd., ORGASOL 3501EX D NAT-1, oil absorption of 212 ml/100 g), 25 parts of the acrylic silicone resin obtained by Synthesis Example 1, and 5 parts of a quaternary ammonium salt (manufactured by Daiiichi Kogyo Seiyaku, Co. Ltd., CATIOGEN L). The aqueous coating solution is coated on a clay-coated and silicone-coated paper (thickness of 90 μm) at coating amount of 30 g/m$^2$ and dried to obtain the transfer sheet.

Comparative Example 1

An aqueous coating solution was prepared by mixing, on solid basis, 70 parts of a nylon powder (manufactured by Daicel Huels, Co. Ltd., Vestamelt 430-P1, oil absorption of 45 ml/100 g), 5 parts of an urethane-series resin emulsion (Daiichi Kogyo Seiyaku, F-8559D), 20 parts of the acrylic silicone resin obtained in Synthesis Example 1 and 5 parts of an aliphatic amine salt (manufactured by MORIN CHEMICAL, Co. Ltd., ACTEX FC-7). The aqueous coating solution is coated on a clay-coated and silicone-coated paper (thickness of 90 μm) at coating amount of 30 g/m$^2$ and dried to obtain the transfer sheet.

Comparative Example 2

An aqueous coating solution was prepared by mixing, on solid basis, 60 parts of a nylon powder (manufactured by Daicel Huels, Co. Ltd., Vestamelt 430-P1, oil absorption of 45 ml/100 g), 35 parts of the acrylic silicone resin obtained by Synthesis Example 1, and 5 parts of a quaternary ammonium salt (manufactured by Daiichi Kogyo Seiyaku, Co. Ltd., CATIOGEN L). The aqueous coating solution is coated on a clay-coated and silicone-coated paper (thickness of 90 μm) at coating amount of 30 g/m$^2$ and dried to obtain the transfer sheet.

The evaluation results of the transfer sheets obtained in Examples 1 to 3 and Comparative Examples 1 to 2 are shown in Table 1

TABLE 1

| | Stain transfer | Washing resistance |
|---|---|---|
| Ex. 1 | ○ | ○ |
| Ex. 2 | ○ | ○ |
| Ex. 3 | ○ | ○ |
| Comp.Ex. 1 | X | ○ |
| Comp.Ex. 2 | X | ○ |

As apparent from Table 1, in the transfer sheet of Examples 1 to 3, stain transfer does not occur. Examples 4 to 8 and Comparative Examples 3 to 5

A cationic urethane-series resin emulsion containing a quaternary ammonium salt (manufactured by Daiichi Kogyo Seiyaku, Co. Ltd., F-8559D) was coated on the paper clay-coated and silicone-coated (thickness of 90 μm) to obtain a sheet having a protecting layer (thickness of 10 μm). Further, an aqueous coating solution was prepared by mixing a nylon powder (manufactured by Daicel Huels, Co. Ltd., Vestamelt 430-P1, oil absorption 45 ml/100 g), a porous nylon powder (manufactured by Atofina Japan, Co. Ltd. (the old name: Atochem, Co. Ltd.), OR-GAZOL3501EX D NAT-1, oil absorption of 212 ml/100 g), polyethylene glycol (manufactured by Sanyo Kasei Kogyo, Co. Ltd., PEG 4000S), urethane-series resin (manufactured by Shin Nakamura Kagaku, Co. Ltd., SP resin ME-307), dye fixing agent (manufactured by Senka, Co. Ltd., PAPIOFEN P109, and quaternary ammonium salt-containing compound) were mixed in the proportion (solid basis) shown in Table 2. The aqueous coating solution was coated on the protecting layer of the sheet and dried to obtain the transfer sheet having the protecting layer and the transfer layer in the thickness shown in Table 2. The evaluation results of the resulting transfer sheets are shown in Table 2.

Example 9

The transfer sheet was obtained in a similar manner to Example 1 except for having no protecting layer. The evaluation results of the resulting transfer sheet are shown in Table 2.

TABLE 2

| | Ex. | | | | | | Comp. Ex. | | |
|---|---|---|---|---|---|---|---|---|---|
| | 4 | 5 | 6 | 7 | 8 | 9 | 3 | 4 | 5 |
| Preparation of the transfer layer (weight ratio) | | | | | | | | | |
| Nylon powder | 68 | 80 | 76 | 42 | 77 | 68 | 85 | 88 | — |
| Porous nylon powder | 17 | 17 | 9 | 43 | 8 | 17 | — | — | — |
| Polyethylene glycol | 5 | 1 | 5 | 5 | 5 | 5 | 5 | 6 | 34 |
| Urethane-series resin | 5 | 1 | 5 | 5 | 5 | 5 | 5 | 6 | 33 |
| Dye fixing agent | 5 | 1 | 5 | 5 | 5 | 5 | 5 | — | 33 |
| Thickness of the transfer layer (μm) | 40 | 40 | 40 | 40 | 40 | 40 | 40 | 40 | 40 |
| Thickness of the protecting layer (μm) | 10 | 10 | 10 | 10 | 10 | — | 10 | 10 | 10 |
| Performance | | | | | | | | | |
| Stain transfer | ○ | ○ | ○ | ○ | ○ | ○ | X | X | X |
| Washing resistance | ○ | ○ | ○ | ○ | ○ | Δ | ○ | Δ | X |

As apparent from the results in Table 2, the transfer sheets of Examples 4 to 9 cause no stain transfer and have excellent washing resistance. On the other hand, the transfer sheets of Comparative Examples 3 to 5 can not satisfy the stain transfer and washing resistance.

What is claimed is:

1. A transfer sheet which comprises a support, a protecting layer capable of separating from the support and a transfer layer formed on the protecting layer, wherein the protecting layer comprises a cationic thermoplastic urethane-series resin, the transfer layer comprises:

a first porous nylon-series hot-melt adhesive fine particle which has an average particle size of 3 to 80 μm, and an oil absorption of not less than 50 ml/100 g, a second nylon-series hot-melt adhesive fine particle which has an average particle size of 3 to 80 μm and an oil absorption of less than 50 ml/100 g, a polyoxyalkylene glycol-series resin, a polyester-type urethane-series resin and a cationic compound, wherein the proportion of the first hot-melt adhesive fine particle to the second hot-melt adhesive fine particle is the former/the latter=10/90 to 40/60 (weight ratio) and, the amounts of the hot-melt adhesive fine particles and the cationic compound relative to 100 parts by weight of the total amount of the polyoxyalkylene glycol-series resin and the polyester-type urethane-series resin are 10 to 5,000 parts by weight and 5 to 150 parts by weight, respectively.

2. A method for producing a transfer sheet which comprises forming, on a release side of a support, a transfer layer recited in claim 1.

3. A method for producing a transfer sheet according to claim 1 which comprises, after forming a protecting layer on the release side of the support, forming a transfer layer.

* * * * *